US007165516B2

(12) United States Patent
Gokan et al.

(10) Patent No.: US 7,165,516 B2
(45) Date of Patent: Jan. 23, 2007

(54) COOLING UNIT FOR AIR-COOLED INTERNAL COMBUSTION ENGINE

(75) Inventors: Yoshitsugu Gokan, Saitama (JP); Yasushi Takahashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 10/989,740

(22) Filed: Nov. 16, 2004

(65) Prior Publication Data

US 2005/0109292 A1 May 26, 2005

(30) Foreign Application Priority Data

Nov. 25, 2003 (JP) ..... 2003-394692
Jun. 18, 2004 (JP) ..... 2004-181275

(51) Int. Cl.
*F02F 1/06* (2006.01)

(52) U.S. Cl. ..... 123/41.69; 165/51

(58) Field of Classification Search ..... 123/41.69; 165/51, 69; 188/268
See application file for complete search history.

(56) References Cited

U.S. PATENT DOCUMENTS 2,396,363 A * 3/1946 Du Bois et al. ..... 165/69
2,417,347 A * 3/1947 Brown ..... 188/268
2,455,708 A * 12/1948 Sherwin ..... 165/69
2,635,858 A * 4/1953 Keller ..... 165/69

FOREIGN PATENT DOCUMENTS

| | | |
|---|---|---|
| JP | 55-92022 | 6/1980 |
| JP | 59-43648 | 3/1984 |
| JP | 63-29161 | 8/1988 |
| JP | 02283935 | 11/1990 |

* cited by examiner

*Primary Examiner*—Tony M. Argenbright
*Assistant Examiner*—Katrina Harris
(74) *Attorney, Agent, or Firm*—Carrier, Blackman & Associates, P.C.; Joseph P. Carrier; William D. Blackman

(57) ABSTRACT

An inventive cooling unit for an internal combustion engine comprises a plurality of cooling fins provided on outer surfaces of a cylinder block and a cylinder head, and vibration control rubbers interposed between cooling fins that face each other so as form a cooling air guide which guides air flow along lateral sides of the engine to rear parts of the engine. The cooling unit significantly increases the cooling efficiency of a cylinder and prevents vibration of cooling fins by interposing vibration control rubbers between cooling fins that face each other. The vibration control rubbers are formed in a streamlined shape and direct the flow of traveling air within the cooling fins about the exterior surface of the engine. The arrangement of the vibration control rubbers on side surfaces of the engine is such that angle α of longitudinal axes of the vibration control rubbers with respect to the advancing direction of the vehicle becomes gradually larger moving from the front to the rear of the engine.

22 Claims, 10 Drawing Sheets

FIG. 3
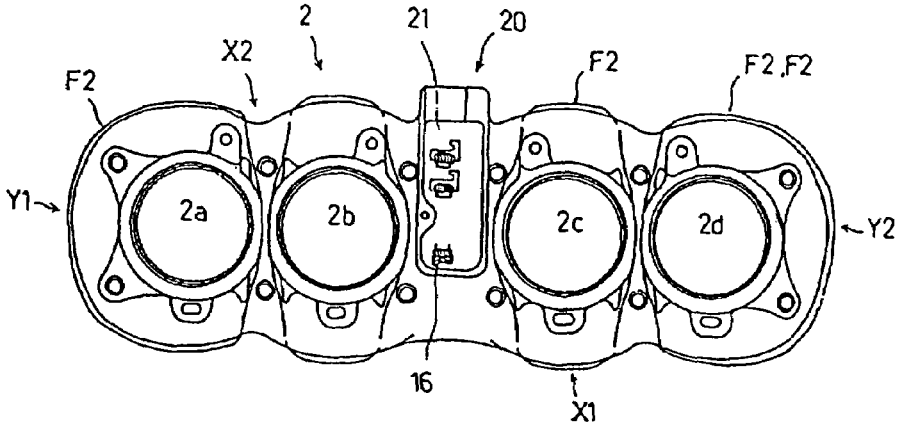
FIG. 4(a)
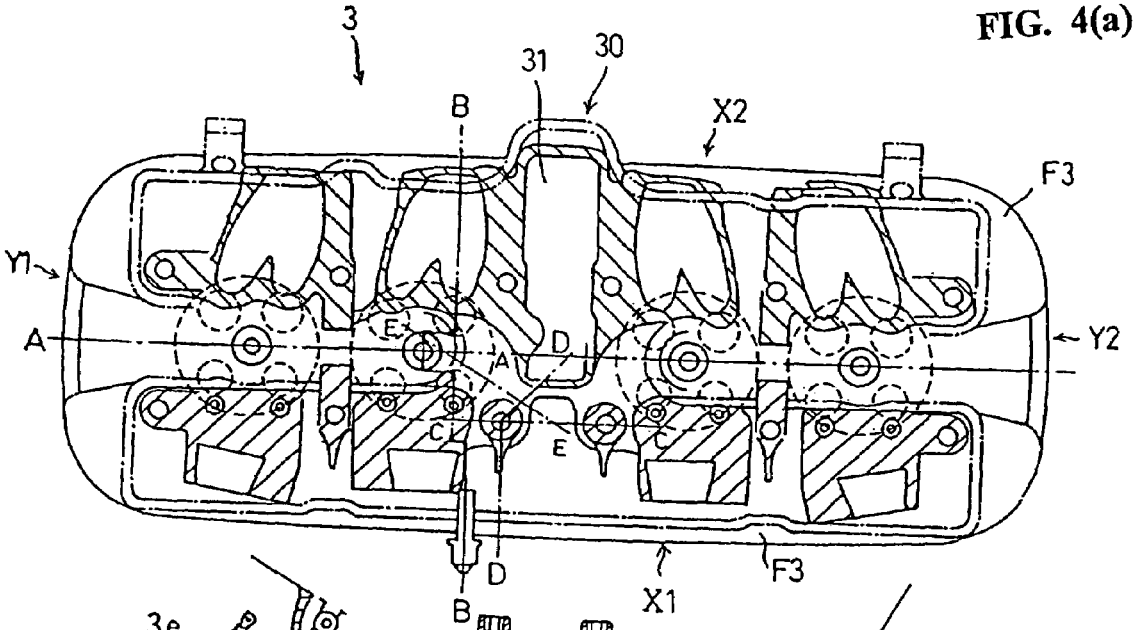
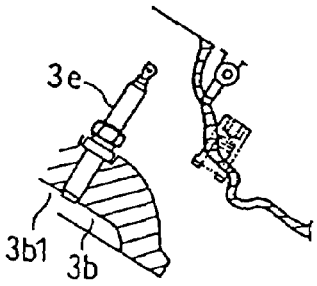
FIG. 4(d)
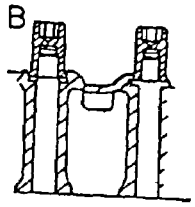
FIG. 4(b)
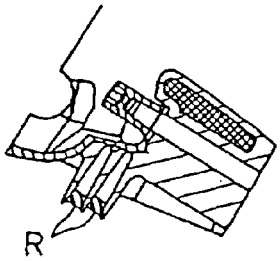
FIG. 4(c)

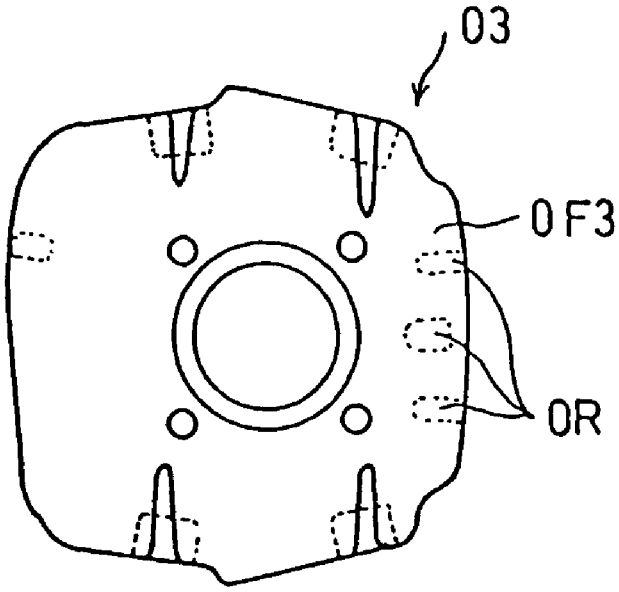
FIG. 9(a)
PRIOR ART
FIG. 9(b)
PRIOR ART
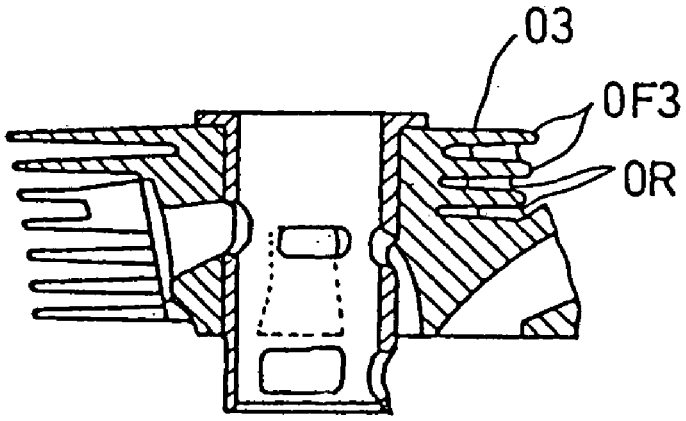

COOLING UNIT FOR AIR-COOLED INTERNAL COMBUSTION ENGINE

CROSS-REFERENCE TO RELATED APPLICATIONS

The present invention claims priority under 35 USC 119 based on Japanese Patent Application Nos. 2003-394692, filed Nov. 25, 2003, and 2004-181275. The subject matter of the priority documents is incorporated herein by reference.

BACKGROUND OF THE INVENTION

1. Field of the Invention

The present invention relates an internal combustion engine, and particularly to improved technology with respect to engine cooling for an air-cooled internal combustion engine for a motorcycle.

2. Description of the Background Art

A known internal combustion engine, and particularly an air-cooled internal combustion engine for a motorcycle, includes a plurality of large cooling fins at an outer peripheral surface of a cylinder block and a cylinder head in order to improve cooling efficiency of the engine. These cooling fins are formed of thin plates creating a large surface area in order to improve cooling efficiency. It is therefore easy for these cooling fins to vibrate. A well-known means for preventing vibration of the cooling fins comprises insertion of elastic members, such as vibration preventing rubber or the like, between the cooling fins. Use of the elastic members between cooling fins is disclosed in Japanese Patent No. 2791896 (page 2, FIG. 2) and Japanese Utility Model Laid-open No. Sho. 59-43648 (page 1, FIG. 1).

In the invention disclosed in Japanese Patent No. 2791896 and Japanese Utility Model Laid-open No. Sho. 59-43648) and shown in present FIG. 9 and FIG. 10, there are respectively disclosed, in an internal combustion engine, and particularly in an air-cooled internal combustion engine for a motorcycle, provision of a plurality of cooling fins OF3 on the outer peripheral surface of a cylinder head 03 of the engine, extending parallel a specified length towards the outside from the outer surface, as cooling measures for the internal combustion engine. A structure is disclosed where elastic bodies such as vibration control rubber OR, having an external shape that is trapezoidal or a substantially square column, is press fitted between cooling fins 0/3, 0/3, of the cooling fins OF3, that are respectively opposite, in order to control vibration of these cooling fins OF3.

However, with the inventions disclosed in Japanese Patent No. 2791896 and Japanese Utility Model Laid-open No. Sho. 59-43648) above, the elastic member such as vibration control rubber press fitted between the cooling fins facing each other has an external shape that is trapezoidal or a substantially square column, and insertion of an elastic member of such as shape between cooling fins is a main cause of a flow separation phenomenon of traveling wind in the cooling fins. This flow separation phenomenon disrupts flow of traveling wind, and inhibits the smooth flow of traveling wind, which means that in order to obtain sufficient cooling capability for an internal combustion engine there remains a problem that a cooling unit is large in size.

Another well-known technique for improving cooling efficiency of a cylinder block includes a structure where central ribs projecting from the upwind side to a substantially central part of each cylinder and connecting upper and lower cooling fins are provided at an upwind side of the cylinder block. In this configuration, cooling wind flows laterally at the central ribs and is caused to pass through wind passing holes, so as to sweep to the rear, preventing muffling and stagnation of heated air around the cylinder block. An example of this configuration is disclosed in Japanese published Utility Model No. Sho 63-29161 (page 2, FIG. 1 and FIG. 2). It is also well known to align a plurality of sideways cooling fins and vertical guidance fins about the cylinder head to improve cooling efficiency. This feature is disclosed in Japanese Utility Model Laid-open No. Sho. 55-92022 (page 1, FIG. 3).

The invention disclosed in Japanese published Utility Model No. Sho 63-29161 described above and shown in present FIG. 11 discloses an engine structure, in a multiple cylinder air-cooled internal combustion engine, at an upwind side of a cylinder block 02, where central ribs 0F projecting to an upwind side and connecting with vertical cooling fins OF2 are provided at substantially central parts of each cylinder, cooling air therefore flows laterally to the central ribs 0F, the cooling air passes air passing holes without stagnating, spreads to the rear and thus improves cooling efficiency.

Further, the invention disclosed in Japanese Utility Model Laid-open No. Sho. 55-92022 disclosed above and shown in present FIG. 12 discloses, in a double overhead cam (DOHC) 4-cycle internal combustion engine having cooling air arriving from the front, provided with a cam cover 04 at an upper rear part of a cylinder head 03, a cooling structure having a plurality of horizontal cooling fins OF3 projecting in a horizontal direction provided on a cylinder head 03, and vertical guidance fins OF facing from a front side end of the horizontal cooling fins OF3 to a rear cover, to bring about improved cooling efficiency of the cylinder head 03.

In the inventions disclosed in Japanese published Utility Model No. Sho 63-29161 and Japanese Utility Model Laid-open No. Sho. 55-92022 above, it is intended, in addition to improving the external rib structure and cooling fin shape structure of the cylinder section, to improve cooling efficiency of the cylinder section by controlling flow of cooling air, and although it is possible to achieve satisfactory cooling, the structure of the resulting cylinder section becomes very complicated, and cost of the engine is increased.

In the above-described circumstances, there is a need to provide a lower cost engine, and to provide a cooling structure for an air-cooled internal combustion engine capable of achieving extremely effective cooling of a cylinder section by adopting simple improved technology without adding separate structural improvement to the structure of the cylinder section.

SUMMARY OF THE INVENTION

The present invention relates to a cooling unit for an air-cooled internal combustion engine for solving the above described problems. A cooling unit for an air-cooled internal combustion engine is provided with a plurality of cooling fins on an outer peripheral surface of the engine. The flat surfaces of the fins are mutually facing each other with a specified distance therebetween. The cooling fins extend horizontally outwards a specified length, and have plural vibration control members interposed between confronting surfaces of adjacent cooling fins. The vibration control members interposed between the cooling fins are disposed with different orientations and/or different external shapes. Depending on the different external shapes, the cooling members are arranged between the cooling fins so as to form a cooling air guide for air to flow between the cooling fins with an improved cooling effect.

The vibration control members may additionally be arranged between adjacent cooling fins at a side surface of the internal combustion engine lying parallel to a traveling direction of the vehicle, on the outer peripheral surface of the internal combustion engine, and the vibration control members having longitudinal axes arranged at different acute angles with respect to the traveling direction of the vehicle. Still further, for each individual vibration control member on a given plane, the acute angle of its respective longitudinal axis relative to the traveling direction of the vehicle increases for vibration control members positioned further to the rear portion of the side surface. For example, the angle of the respective longitudinal axis relative to the traveling direction of the vehicle for a vibration control member positioned at the rear is largest, for a vibration control member positioned at the front is smallest, and for intermediate vibration control members, the angle gradually increases for vibration control members having more rearward positions. Also, the external shape of the different types of vibration control members is streamlined and can be teardrop-shaped, a wing section shape, or an elliptical.

In a first aspect of the invention, a cooling unit is provided for an air-cooled internal combustion engine. The cooling unit includes a plurality of cooling fins maintaining a specified distance from an outer surface of the engine while mutually facing a flat surface section of the engine. The cooling fins extend horizontally outwards a specified length, and have vibration control members interposed between relatively facing, or confronting, cooling fins. The vibration control members interposed between the cooling fins being disposed in different orientations, and the vibration control members are arranged between the cooling fins based on the different orientations thereof so as to form a cooling air guide for air to flow between the cooling fins. As a result, the vibration control members, having different orientations, prevent traveling wind separation from cooling fins acting as cooling air guides. Vibration of cooling fins due to traveling wind flow is controlled, and it is possible to ensure smooth flow of cooling air, resulting in improved cooling efficiency for the engine.

In another aspect of the invention the cooling fins are positioned at a side outer surface of the internal combustion engine so as to be parallel to a traveling direction of the engine, and the vibration control members are arranged between adjacent cooling fins such that longitudinal axes of the vibration control members are arranged at different acute angles with respect to a traveling direction of the engine. As a result, the vibration control members, having different orientations, have a longitudinal axis that effectively forms an acute angle with respect to the traveling wind direction. The resistance of the vibration control members to the traveling wind is small, and the traveling wind is directed so as to be efficiently spread over all external parts of the internal combustion engine, including those at the rear thereof, at an angle that maximizes the flow rectification.

In another aspect of the invention, the vibration control members between adjacent ones of the cooling fins are disposed such that longitudinal axes thereof extend at different angles with respect to a traveling direction of the engine, and the angles are larger for those of the vibration control members positioned further to the rear of the side surface of the engine than for those of the vibration control members positioned in the middle of the side surface of the engine. As a result, since it is possible to suck in traveling air even to parts at the rear of the engine, cooling air spreading over all cooling fins provided on external surfaces of the engine is guided, and it is possible to use these cooling fins for efficient heat transfer.

In another aspect of the invention, the vibration control members are teardrop shaped, which means that the flow adjustment effect is more pronounced due to the streamlined nature of the teardrop external shape. In this configuration, the vibration control members prevent traveling wind separation from cooling fins acting as cooling air guides, the vibration of cooling fins due to traveling wind flow is controlled, and it becomes possible to ensure smooth flow of cooling air, resulting in improved cooling efficiency for the engine.

In yet another aspect of the invention, alternative streamlined external shapes are provided for the vibration control members, which include a wing section shape and an elliptical shape. The same effects as for the invention using a teardrop shaped vibration control member are achieved.

In the inventive cooling unit for an air-cooled internal combustion engine, vibration control members with different orientations and/or having different external shapes are inserted between cooling fins provided on external surfaces of an internal combustion engine. For a more complete understanding of the present invention, the reader is referred to the following detailed description section, which should be read in conjunction with the accompanying drawings. Throughout the following detailed description and in the drawings, like numbers refer to like parts. It should be understood, however, that the detailed description of a specific example, while indicating the present embodiment of the invention, is given by way of illustration and not of limitation. Many changes and modifications may be made within the scope of the present invention without departing from the spirit thereof, and the invention includes all such modifications.

BRIEF DESCRIPTION OF THE DRAWINGS

FIG. 3 is a top plan view showing a cylinder block of the inventive engine of FIG. 1, showing the cooling fins F2 formed about the cylinders.

FIG. 4*a* is a top plan view of the cylinder head of the inventive engine of FIG. 1, showing the cooling fins F3 formed about the cylinder head.

FIG. 4*b* is a sectional view taken along line C—C of FIG. 4*a*.

FIG. 4*c* is a sectional view taken along line D—D of FIG. 4*a*.

FIG. 4*d* is a sectional view taken along line E—E of FIG. 4*a*.

FIG. 9*a* is a top plan view of the structure of a cooling fin of a prior art cylinder head.

FIG. 9*b* is a side cross sectional view of the structure of FIG. 9*a*.

DETAILED DESCRIPTION OF THE INVENTION

Figure 1:
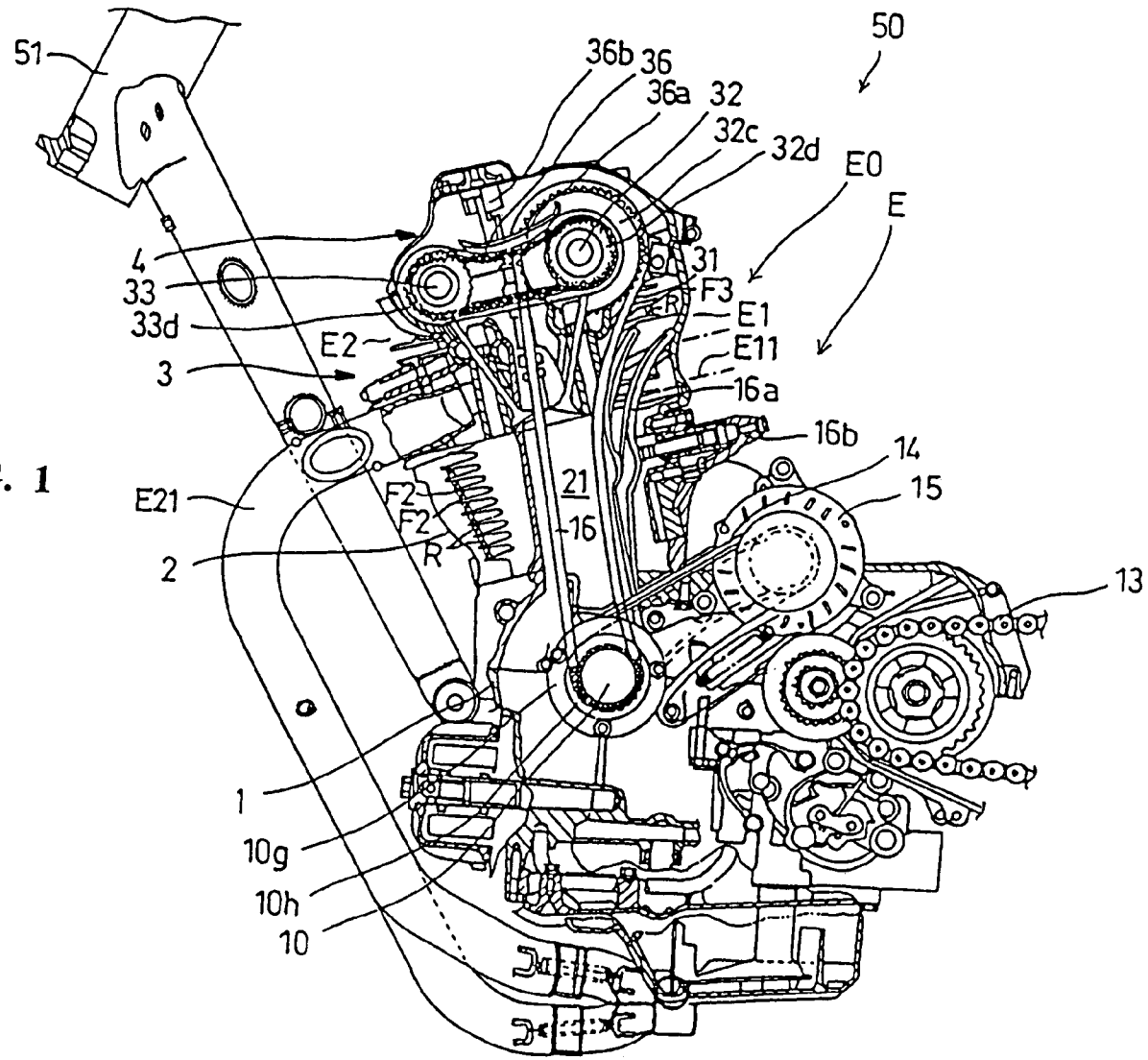
FIG. 1 is a partial side elevation view of a vehicle supporting the internal combustion engine having the improved cooling unit according to an embodiment of the present invention, showing cooling fins formed on external surfaces of the cylinder block and cylinder head.

Embodiments of the present invention will be described based on FIG. 1 to FIG. 8. FIG. 1 shows a partial view of the structure of a motor cycle 50, fitted with an air-cooled internal combustion engine E of this embodiment. In the following description, references to "front" or "forward" correspond to the front end of the vehicle (or engine) with respect to the advancing direction of the vehicle. Likewise, references to "back" or "rear" correspond to the rear end of the vehicle (or engine).

The motorcycle 50 is provided with a head pipe 51 forming a front section of a vehicle frame, with a front fork, not shown, for supporting a front wheel capable of swiveling being attached to a lower part of the head pipe 51, and a handle bar, also not shown, being attached to an upper part of the head pipe 51.

Also, a main frame, not shown, is attached to the head pipe 51, with a seat, back stay and swing arm for supporting a rear wheel, all not shown, being attached to this main frame.

The internal combustion engine E is mounted in the vehicle frame, and FIG. 1 shows an elevational view of the engine E as seen from the side. An air-cooled 4-cycle in-line 4 cylinder engine E is used to illustrate the inventive cooling unit. Engine E is provided with a twin overhead cam structure (DOHC). When mounting the engine to the vehicle 50, a head exhaust port side E2 of a cylinder EO is oriented in the traveling direction, an intake port side E1 is arranged oriented in the upper left direction, an intake pipe E11 extends upwards to the right from an upper part of the cylinder EO, and a carburetor and air cleaner, not shown, are connected to this intake pipe E11. Also, an exhaust pipe E21 extends from a front side of the cylinder EO to the rear, passing below the vehicle body, as shown in FIG. 1.

The cylinder EO of the engine E has a lower part fixedly mounted on an upper part of a crankcase 1. The cylinder EO is made up of a cylinder block 2 continuously fixed to a direct connected crankcase 1, a cylinder head 3 having a lower part continuously fixed to an upper part of the cylinder block 2, and a cylinder head cover 4 covering an upper part of the cylinder head 3 and fixed to the head 3. These structural components are integrated together using stud bolts or the like.

Figure 2:
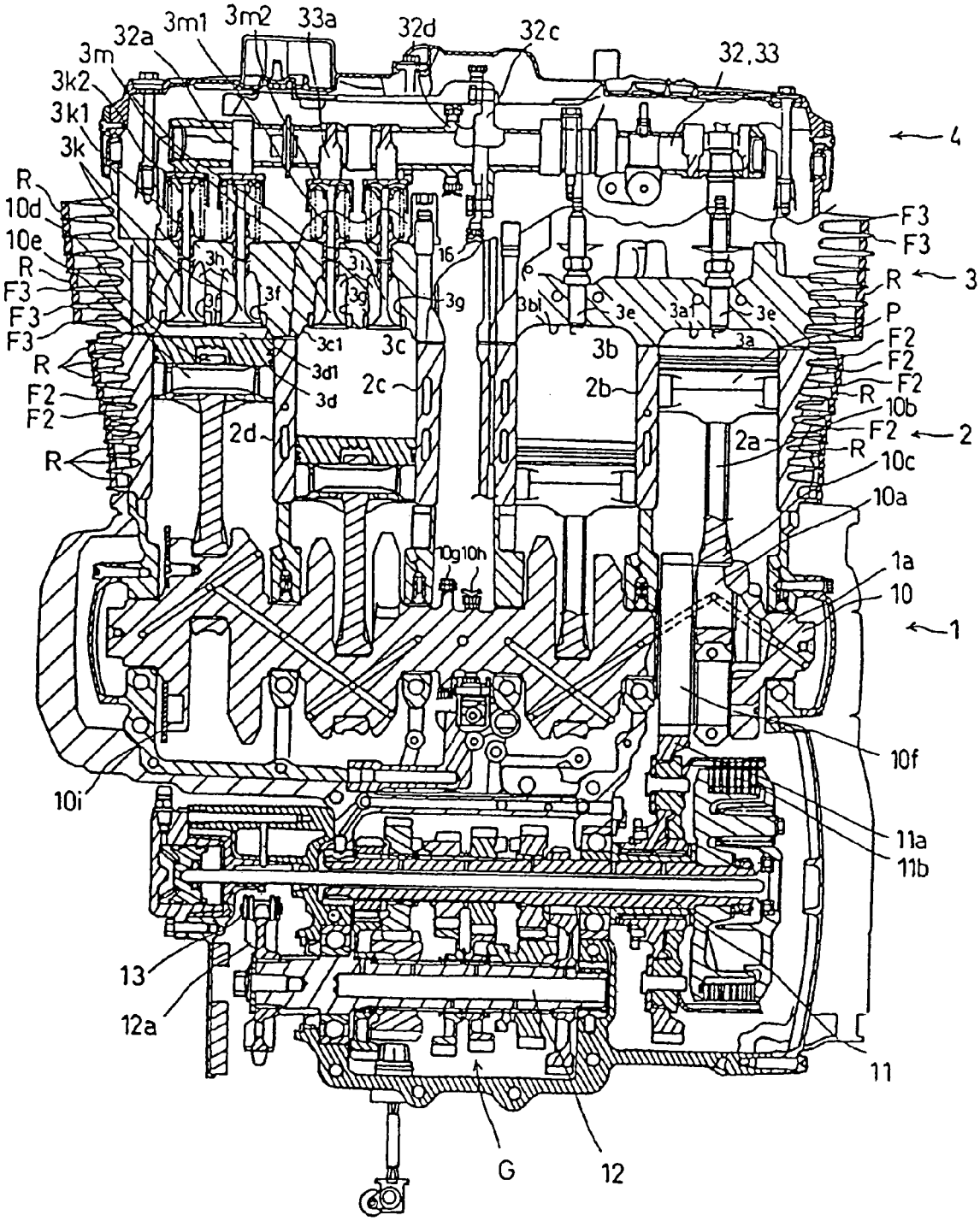
FIG. 2 side sectional view of the inventive engine of FIG. 1, and shows the arrangement of cooling fins about the engine cylinders and valve drive mechanisms.
Figure 5:
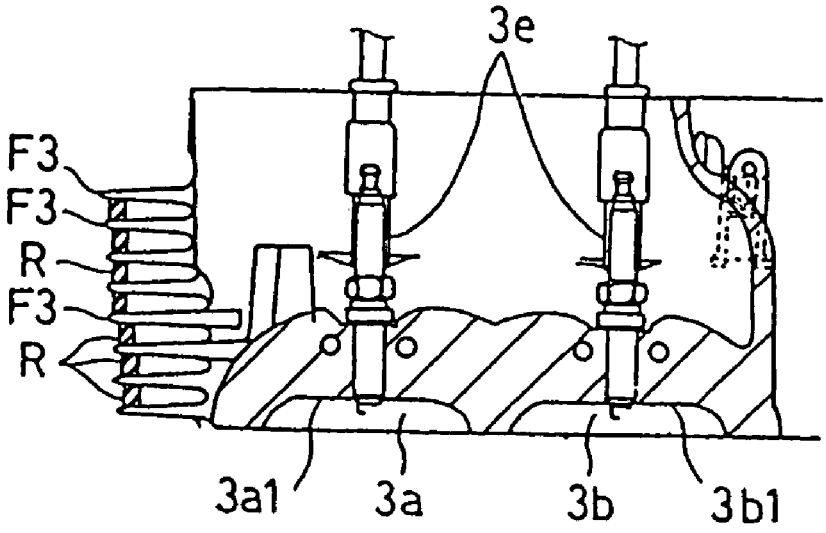
FIG. 5 is a detail sectional view taken along line A—A of FIG. 4*a*.

As shown in FIG. 2, a crank shaft 10 is supported in the crankcase 1 so as to be capable of turning, by means of a plurality of journal bearings 1*a*. Respective connecting rods 10*b* are attached via their big ends 10*c* to crank pins 10*a* at four places on the crankshaft 10, with respective pistons P being attached to the little ends 10*d* of these connecting rods 10*b*. The pistons P then reciprocate inside cylinder bores 2*a* to 2*d* formed in the cylinder block 2.

Also, a drive gear 10*f* is attached to the crankshaft 10 at a position slightly to the right in the longitudinal direction of the drawing. The drive gear 10*f* meshes with a driven gear fitted on a main shaft 11 of a transmission, drive force from the crankshaft 11 is transmitted from the driven shaft 11*a* via a switching clutch 11*b* to the main shaft 11. The drive force is conveyed to a counter shaft 12 by way of the main shaft 11 and selective gear meshing of a reduction gear G on the counter shaft 12. The drive force that has been transmitted to the counter shaft 12 is transmitted to a rear wheel, wherein the rear wheel is a drive wheel for travel of the vehicle, not shown, by way of a drive chain 13 using a drive sprocket 12*a*.

Sprockets 10*g*, 10*h* having two different diameters arranged in parallel at a substantially central part in the longitudinal direction are provided on the crankshaft 10, with the larger diameter sprocket 10*g* driving a generator 15 via a chain 13 (refer also to FIG. 1). A starter motor that is coaxial via a one-way clutch, not shown, is connected to the generator 15. Also, the smaller diameter sprocket 10*h* drives camshafts 33, 34 by means of a chain 16. A pulsar rotor 10*i* is attached at a position of the crankshaft 10 that is to the left end of the engine in the longitudinal direction as seen in the FIG. 2.

The cylinder block 2 fixedly mounted on an upper part of the crankcase 1 is formed in a substantially rectangular shape that is long in a direction orthogonal to the front to rear direction of the vehicle 50, when viewed from above (plan view). As shown in FIG. 3, four cylinder bores 2*a* to 2*d* are arranged in parallel along the longitudinal direction. The cylinder bores 2*a* to 2*d* pass vertically through the cylinder block 2, with the pistons P, capable of reciprocating motion, arranged inside the cylinder bores 2*a* to 2*d*.

A hollow section 21 for the chain 16 for driving the above described cam shafts 32, 33 to pass through is formed in a longitudinally central section 20 of the cylinder block 2. The hollow section 20 passes vertically through the cylinder block 2 at a position slightly to the rear, in a width direction of the cylinder block 2, of the longitudinally central section 20, and forms a substantially rectangular shape that is long in the width direction when looking from above the cylinder block 2. Accordingly, the four cylinder bores 2*a* to 2*d* of the cylinder block 2 are arranged about the longitudinally central section 20 of the cylinder block 2 so as to be spaced two to the left, and two to the right, of the longitudinally central section 20 and separated from each other by the hollow section 21.

As will become clear also from reference to FIG. 1 and FIG. 2 etc., a plurality of cooling fins F2 are provided on the outer surface of the cylinder block 2. In addition, a plurality of cooling fins F3 are provided on the outer surface of the cylinder head 3. Because the characteristic structure of the cooling fins F2 is common to that of cooling fins F3, the detailed structure of the cooling fins F2 and F3 is described later and so is omitted here.

The cylinder head 3 fixed to the upper part of the cylinder block 2 is shown in FIG. 4(*a*), which is a cross section of the cylinder head 3 viewed from above. As will be understood from this drawing, the cylinder head 3 has substantially the same rectangular shape as the cylinder block 2. Also, as will be clear from reference to FIG. 2 and FIG. 5, there are four concave sections 3*a*1 to 3*d*1 on the bottom part of the cylinder head 3 corresponding to the four cylinder bores 2*a* to 2*d* of the cylinder block 2, and combustion chambers 3*a* to 3*d* are respectively defined by the concave sections 3*a*1 to 3*d*1 and the cylinder bores 2*a* to 2*d* of the cylinder block 2.

Figure 6:
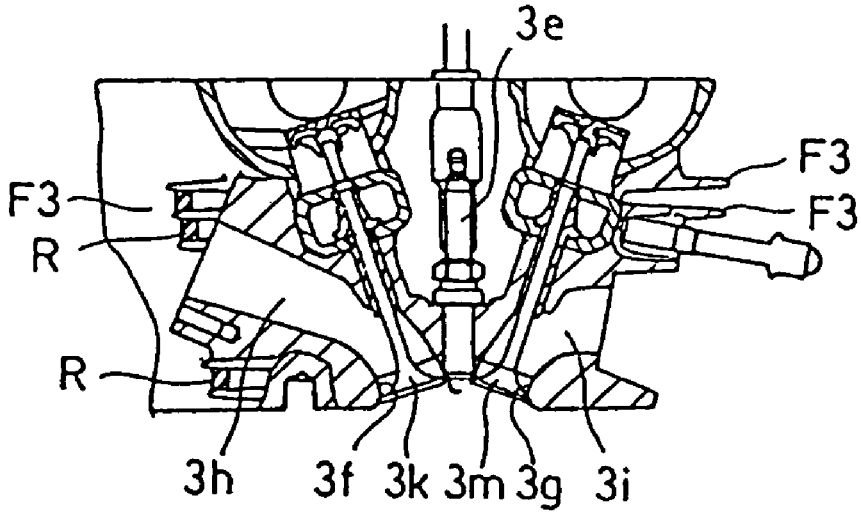
FIG. 6 is a detail sectional view taken along line B—B of FIG. 4*a*.

Spark plugs 3*e* are fitted into the respective combustion chambers 3*a* to 3*d* so as to face into the chambers, and also, as shown in FIG. 2 and FIG. 6, respective intake ports and exhaust ports 3*f*, 3*g* are formed in these combustion chambers 3*a* to 3*d*. Intake passageways and exhaust passageways 3*h* and 3*i* are connected to the intake ports 3*f* and exhaust ports 3*g*. Fuel injection units, not shown, are fitted into the intake passages 3*h*. In addition, a valve gear comprising two cam shafts 32, 33, provided with intake and exhaust valves 3*k*, 3*m* for opening and closing the intake ports and exhaust ports 3*f* and 3*g* of the combustion chambers 3*a* to 3*d* and cam shafts 32*a* and 33*a* for driving the intake valve 3*k* and exhaust valve 3*m* to open and close, is arranged in a structural part of the cylinder head 3.

In the above described plan view of the cylinder head shown in FIG. 4, a space section, or vacancy, 31 for a cam shaft drive chain passing vertically through the head 3 having a specified width and length is provided in a longitudinally central part 30 of the cylinder head 3 and positioned to the rear in a width direction. The space section 31 has its position aligned with the space section 21 for the chain 16 provided in the cylinder block 2 so as to overlie space section 21. In a portion where the cylinder head 3 and the cylinder block 2 are joined, the opening shape of these space sections 21 and 31 is defined so that they vertically align with each other.

Therefore, as shown in FIG. 1, the cam shaft chain 16 passing through the space sections 21 and 31 is arranged to pass without hindrance or interference from the crankshaft 10 to an upper part of the cylinder head 3. As shown in FIG. 1, a chain tensioner 16*a*, and a damper 16*b* for adjusting tension of the chain tensioner, are provided.

As will be understood from reference to FIG. 1 and FIG. 2 etc., the valve gear mechanism comprises two cam shafts 32, 33 provided with a plurality of cams 32*a*, 33*a*, and a valve operating mechanism including a drive mechanism for driving the cam shafts 32, 33, and valve lifters 3*k*2, 3*m*2 for the intake and exhaust valves 3*k*, 3*m* for contacting the cams 32*a*, 33*a* to press the valve stems 3*k*1, 3*m*1.

The two cam shafts 32, 33 are supported by bearings at an upper part of the cylinder head 3 so as to be capable of rotation, maintaining a specified distance in the front to rear direction so as to be orthogonal with respect to the advancing direction of the vehicle 50 and having a positional relationship parallel to each other. The cams 32*a*, 33*a*, respectively provided on the cam shafts 32, 33 (refer to FIG. 2), respectively contact the valve lifters 3*k*2, 3*m*2 in order to open and close the intake and exhaust valves 3*k*, 3*m*, as described above.

Accordingly, these cams 32*a*, 33*a* are arranged on the camshafts 32, 33 corresponding to upper ends of valve stem sections 3*k*1, 3*m*1 of each intake and exhaust valve 3*k*, 3*m*. In this embodiment, the cam shaft 32 to the rear side of the vehicle 50 is the cam shaft on which the opening and closing cam 32*a* for the intake valve 3*k* is arranged, while the cam shaft 33 to the front is the cam shaft on which the cam 33*a* for opening and closing the exhaust valve 3*m* is arranged. As shown in FIG. 2, this is a so-called 4 valve system with two intake valves and two exhaust valves respectively arranged for each of the combustion chambers 3*a* to 3*d*. Eight cams 32*a*, 33*a* are respectively arranged on these two cam shafts 32, 33.

As shown in FIG. 1, rotational force from the crankshaft 10 is transmitted to the rear camshaft 32 of the two camshafts 32, 33 arranged at the upper part of the cylinder head 3. This power transmission is achieved using the cam drive chain 16 wound between the sprocket 10*h* of the crankshaft 10 and the sprocket 32*c* of the camshaft 32. Drive force transmitted to the rear cam shaft 32 is also transmitted to the front camshaft 33, and this power transmission is achieved using an inter-cam shaft drive chain 36 wound between the sprocket 32*d* of the rear cam shaft 32 and the sprocket 33*d* of the front cam shaft 33.

As a result, in operation of the internal combustion engine E, rotational drive force of the crankshaft 10 is respectively transmitted to the two cam shafts 32, 33 by means of the cam shaft drive chain 16 and the inter-cam shaft drive chain 36. Opening and closing of the intake and exhaust valves 3*k*, 3*m* in synchronism with rising of the piston P, as is well known, is achieved using rotation of the cams 32*a*, 33*a* synchronized with rotation of the crankshaft due to rotation of the two cam shafts 32, 33, by means of pressing of the above described valve lifters 3*k*2, 3*m*2 and 3*k*1, 3*k*2, to perform induction and exhaust in combustion of the engine.

As shown in FIG. 1, FIG. 2 and FIG. 4, FIG. 5 etc., a plurality of cooling fins F3 that are the same as those on the outer surface of the cylinder block 2 are provided on the outer surface of the cylinder head 3.

Figure 7:
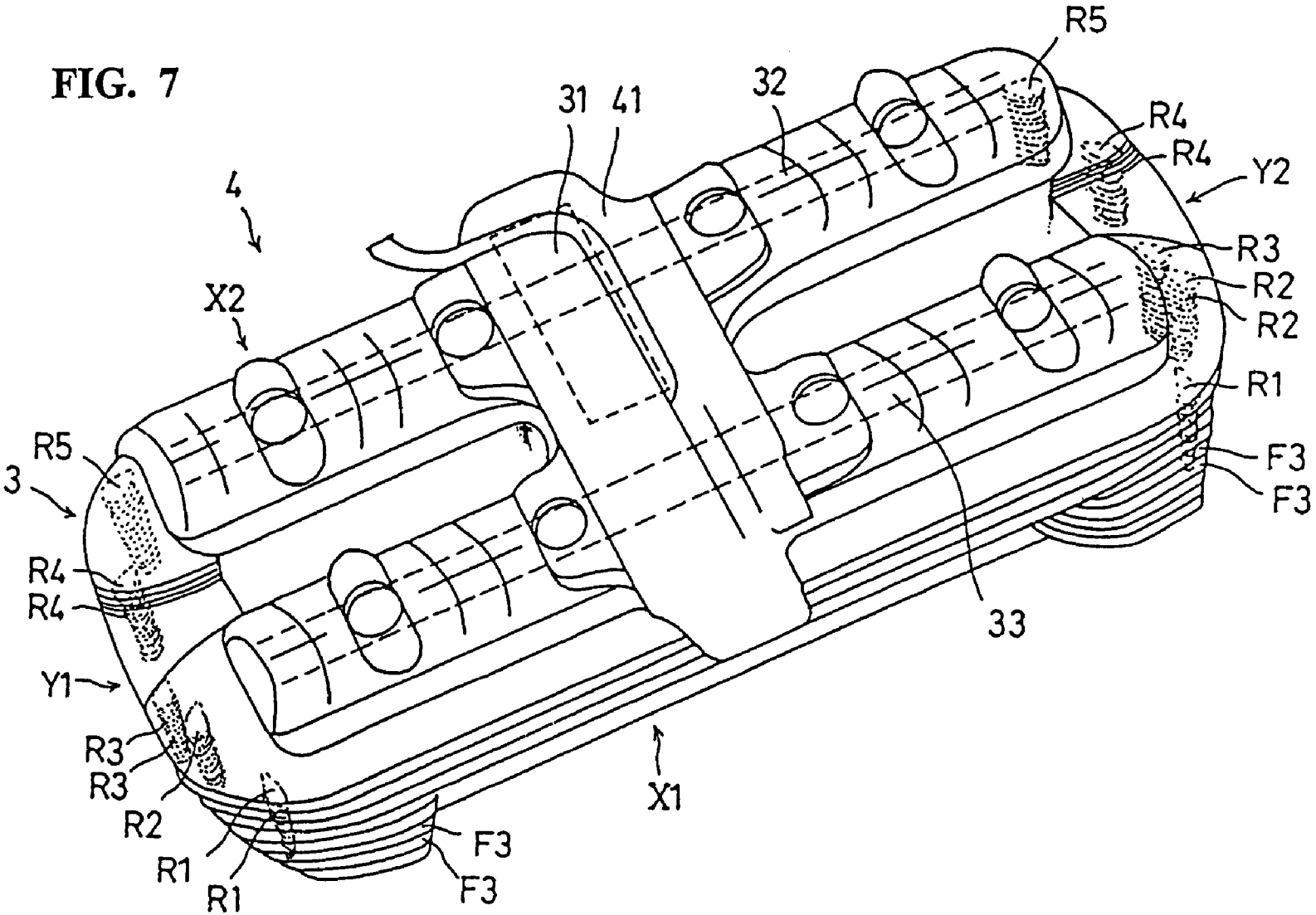
FIG. 7 is a top perspective view of the cylinder head cover of the inventive engine of FIG. 1 attached to the cylinder head, showing that plural vibration control members are provided between a given pair of adjacent fins, for example R1–R5, and showing that vibration control members are provided for each of the plural pairs of adjacent fins.

The upper part of the cylinder head 3 is covered by the cylinder head cover 4. As shown in FIG. 7, which is a perspective view showing the cylinder head cover 4, the cylinder head cover 4 is provided with a substantially rectangular structure elongated in a direction orthogonal to the traveling direction of the vehicle, so as to have the same shape as the cylinder head 3. The cover 4 covers the two camshafts 32, 33 almost completely from above, but an upper part of a space housing the sprockets 32*c*, 32*d* and 33*d*, attached to a substantially central part in the longitudinal direction of the cam shafts 32, 33, and in which the chains 16 and 36 move, is covered by a separate chain cover 41.

Therefore, the chain cover 41 effectively forms a transverse section of the central part of the cylinder head cover, with the result that the cylinder head cover 4 has an external shape that is a substantial H-shape overall looking from above, as shown in FIG. 7.

The cylinder block 2, cylinder head 3 and cylinder head cover 4 of the internal combustion engine E of this embodiment have the structure as has already been described. A plurality of cooling fins F2, F3 are provided on respective outer surfaces of the cylinder block 2 and the cylinder head 3 and will now be describe with respect to FIGS. 1–5.

Specifically, a plurality of cooling fins F2, F3 are provided on the cylinder block 2 and the cylinder head 3 so as to be respectively parallel to both the long surfaces X1, X2, which extend transversely to the front to rear direction of the block 2 and head 3 with respect to the traveling direction of the vehicle 50, and the short surfaces Y1, Y2, which extend on both sides of the block 2 and head 3 in a direction parallel to the traveling direction. Cooling fins F2, F3 are equally spaced or substantially equally spaced, and extend in a pointed fashion a specified length from the surface.

With respect to the above described surfaces of the cylinder block 2 and the cylinder head 3, that is, the respective surfaces X1, X2, which are the long surfaces on the front and rear sides of the engine, and the short surfaces Y1, Y2 of both lateral sides, the cooling fins F2, F3, extending in a pointed fashion, are formed as flat plate projecting sections that are comparatively thin to increase surface area in consideration of heat dissipation effect. There is no difference between cooling fins F2 and cooling fins F3 in basic structure, but due to considerations in the design of the cylinder block 2 and the cylinder head 3, the places where these cooling fins F2, F3 are mounted and the extension length from the outer surfaces etc. may differ slightly.

As a characteristic structure of the cooling fins F2, F3 of this embodiment, vibration control members, or rubbers, R, made of heatproof rubber or the like, are inserted between respective adjacent pairs of confronting cooling fins. That is, the vibration control members R are positioned between cooling fins F2, F2 and between cooling fins F3, F3 that face each other. Plural vibration control members R are inserted between paired cooling fins F2, F2, and paired cooling fins F3, F3, of the surfaces X1, X2 that are long in the front to rear direction of the cylinder block 2 and the cylinder head 3 and the short surfaces Y1, Y2 of both sides. The external shape of these vibration control members, or rubbers, R is streamlined, looking from above, as shown in FIG. 8.

Figure 13A:
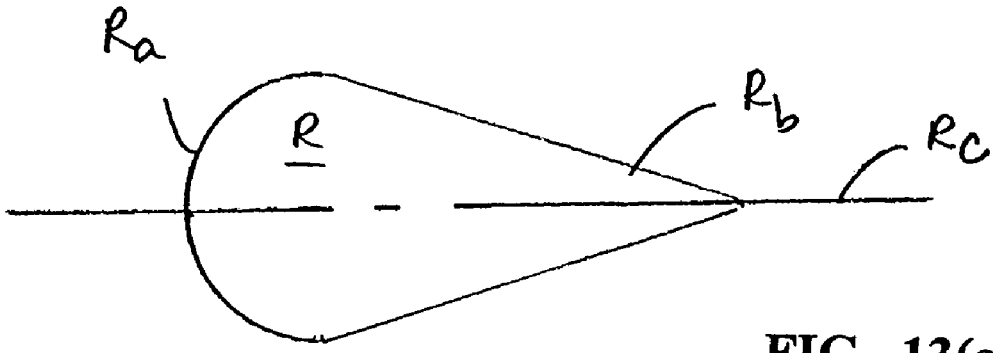
FIG. 13*a* is a top plan view of the tear drop-shaped external shape of a vibration control rubber member according to an embodiment of the present invention.

Specifically, the vibration control rubbers R are made up of arc-shaped head sections Ra, and rear sections Rb (FIG. 13*a*). Rear section Rb is formed from two surfaces extending from the arc-shaped head section Ra symmetrically and smoothly coming closer together going to the rear so as to converge to an apex. The resulting shape is a so-called teardrop shaped streamlined shape. The vibration control rubbers R also comprise a longitudinal axis Rc that extends between a midpoint of the arc-shaped head section Ra through the apex of the rear section Rb. These streamlined, teardrop-shaped vibration control rubbers R are then press inserted between each confronting pair of adjacent cooling fins F2, F2 and each confronting pair of adjacent cooling fins F3, F3. The individual vibration control rubbers R have an arrangement with a specified directivity and a specified distance apart.

The directional arrangement of the vibration control rubbers R, having a streamlined external shape when viewed from above, between confronting cooling fins F2, F2 and confronting cooling fins F3, F3 is particularly characterized by the short surfaces Y1 and Y2 on both sides of the cylinder block 2 and the cylinder head 3. The vibration control rubbers R between the cooling fins F2, F2 and the cooling fins F3, F3 are inserted at a specified distance along a curved line traced by the short surfaces Y1 and Y2 on both sides, so as to be positioned at a location spaced a small distance from the peripheral edge of the cooling fin along a curved line that substantially mirrors the edge shape of the cooling fin. In this embodiment, the vibration control rubbers are arranged at five places, respectively, on the short surfaces Y1, Y2 on both sides of the engine. The appearance of the insertion arrangement of the vibration rubbers R between the cooling fins F2, F2 and F3, F3 is shown in FIG. 7 and FIG. 8. FIG. 7 shows that the arrangement, including positioning, spacing, and orientation, of vibration control rubbers between each fin pair is repeated for all fin pairs.

Figure 8:
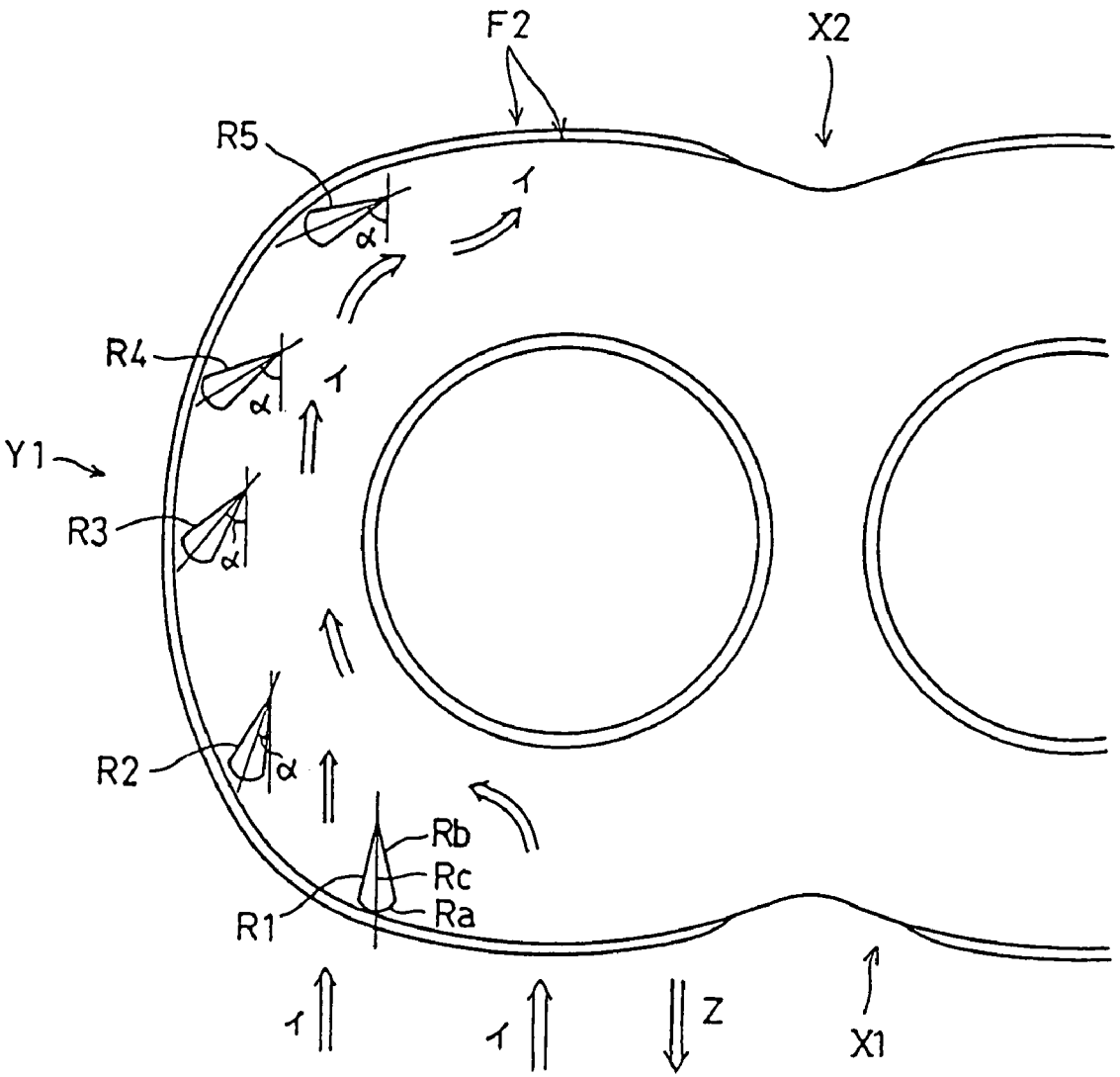
FIG. 8 is a top plan view of a portion of a single cooling fin of the inventive engine of FIG. 1 in an explanatory drawing to show the shape of vibration control rubber members inserted between cooling fins of the present invention, the relative orientation of each vibration control rubber member with respect to the advancing direction of the vehicle, as indicated by the open arrow marked "z", and the effect of this arrangement on the direction of wind flow, as indicated by open arrows marked "τ".
Figure 10:
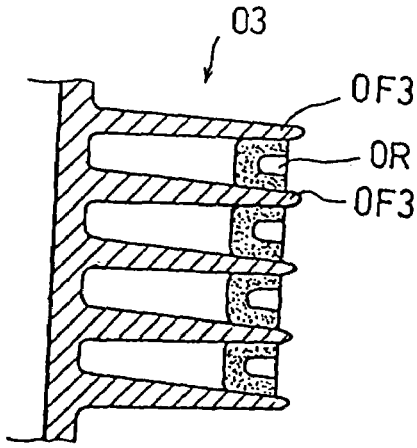
FIG. 10 PRIOR ART
FIG. 10 is a side cross sectional view showing a second example of a prior art cylinder head.
Figure 11A:
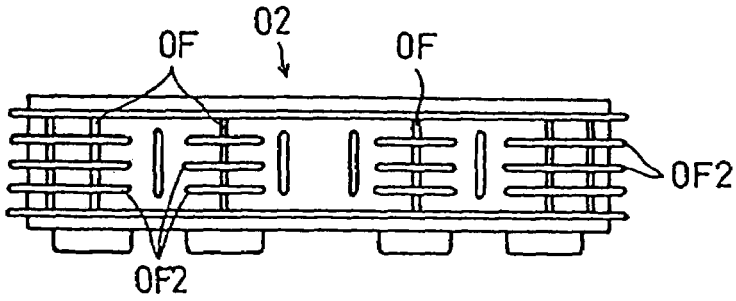
FIG. 11(a) PRIOR ART
FIG. 11*a* is a side elevational view of a prior art cylinder block.
Figure 11B:
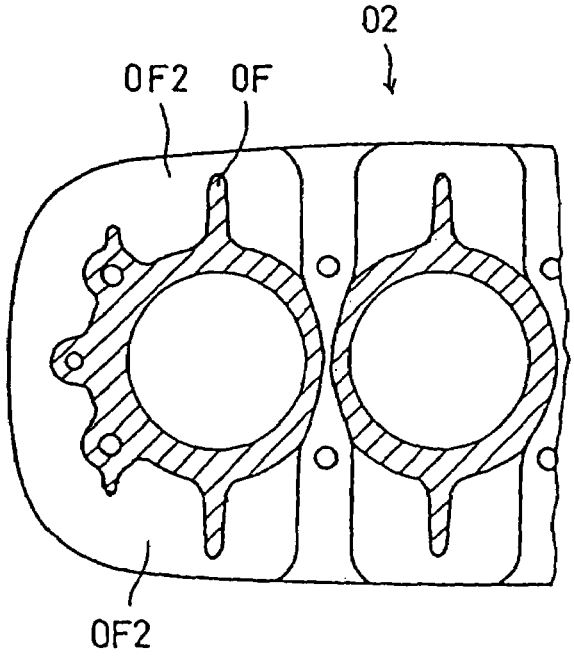
FIG. 11(b) PRIOR ART
FIG. 11*b* is a partial plan view of the prior art cylinder block of FIG. 11*a*.
Figure 12:
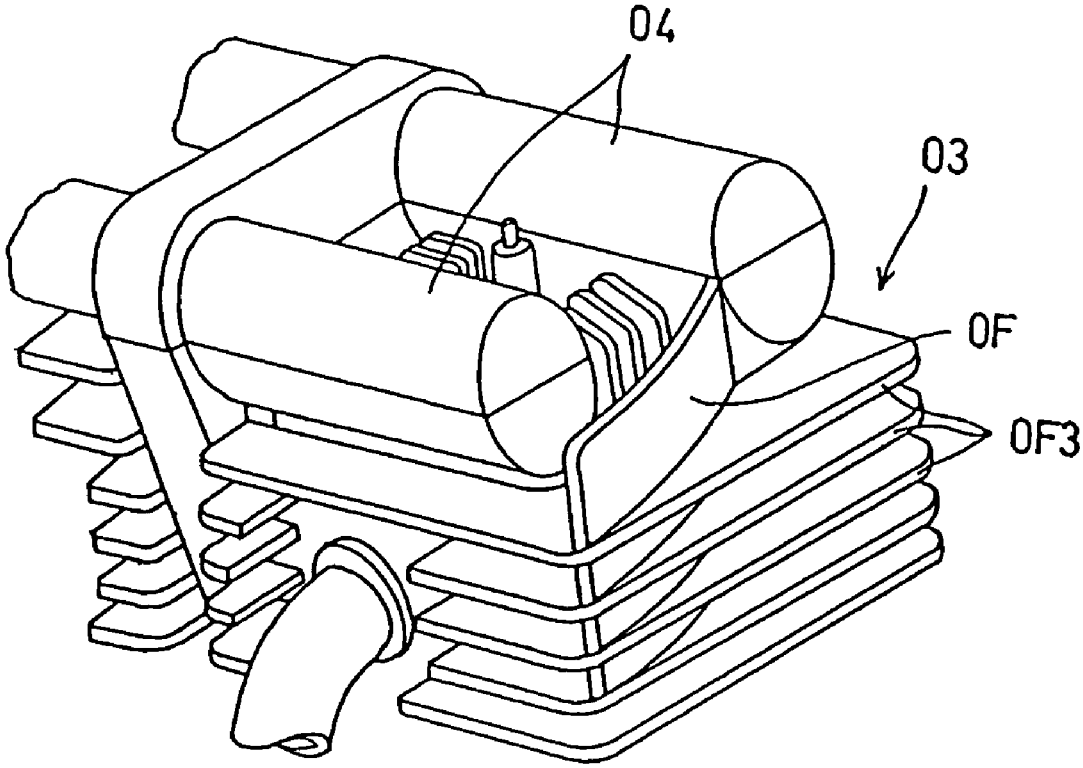
FIG. 12 PRIOR ART
FIG. 12 is a perspective view of another example of a prior art cylinder head.

Specifically, the appearance of the insertion arrangement of the vibration control rubbers R in the cylinder block 2 and the cylinder head 3 is shown in FIG. 8. A first vibration control rubber R1 arranged at the front side (only one side Y1 is shown in FIG. 8) of the short surface Y1, Y2 on both sides of the cylinder block 2 and the cylinder head 3, that is, arranged at positions close to both ends of a long surface X1 effectively in front of the bock 2 and the head 3, is arranged so that the arc-shaped head section faces to the front and the longitudinal axis Rc is parallel or substantially parallel to the advancing direction of the vehicle 50. That is, a first vibration control rubber R1 is arranged so that an angle a formed by the longitudinal axis Rc of the vibration control member R1 with respect to the advancing direction Z of the vehicle 50 is an angle close to 0 degrees.

Second to fifth vibration control rubbers R2 to R5 are oriented on the short surfaces Y1, Y2 of both sides of the cylinder block 2 and the cylinder head 3 so that, moving from the front of the block 2 to the rear, the inclination angle $\alpha$ of the longitudinal axis Rc with respect to the advancing direction of the vehicle 50 becomes successively larger. With respect to the vibration control rubber R5 arranged furthest to the rear of the short surfaces Y1, Y2 of both sides, that is, the fifth vibration control rubber R5 arranged at a position close to the two ends of the long surface X2 behind the cylinder head 3, the longitudinal axis Rc is inclined with respect to the advancing direction of the vehicle 50 until it is almost normal thereto (the inclination angle is almost 90 degrees). However, it should be understood that the inclination angle is set to be 90 degrees or less, that is, an acute angle.

Traveling wind, or wind generated by the forward motion of the vehicle, strikes the front long surface X1 of the cylinder head 3 and flows along the surface X1, and circulates to both sides, flows along the short surfaces Y1, Y2 at both sides of the cylinder head 3 and flows directly. The flows of traveling wind are guided, directed, and adjusted by the streamlined vibration control rubbers R1 to R5, and as shown the wind flows between adjacent pairs of said cooling fins substantially parallel to a plane of said cooling fins. The flow of traveling wind is formed into a smooth flow without separation from these vibration control rubbers R1 to R5, and guided to the rear along the shorts surfaces Y1, Y2 of both sides. The traveling wind flow is further guided to the rear of the cylinder block 2 and cylinder head 3 so as to engulf the rear sections, and in this way, the cooling efficiency of the block 2 and head 3 is significantly improved.

The vibration control rubbers R arranged between the cooling fins F2, F2, and F3, F3 of the cylinder block 2 and cylinder head 3 substantially remove the occurrence of a separation phenomenon of the traveling wind due to the effects of the streamlined external shape. Vibration of the vibration control rubbers R themselves due to disturbance of traveling wind is suppressed. Also, since insertion of the vibration control rubbers between the cooling fins F2, F2 and F3, F3 is achieved by pressure, the cooling fins F2, F2, F3, F3 facing each other are pressed so as to be opened out by the elastic force of the inserted vibration control rubbers R, which means that vibration of the thin plate structure is effectively suppressed.

Figure 13B:
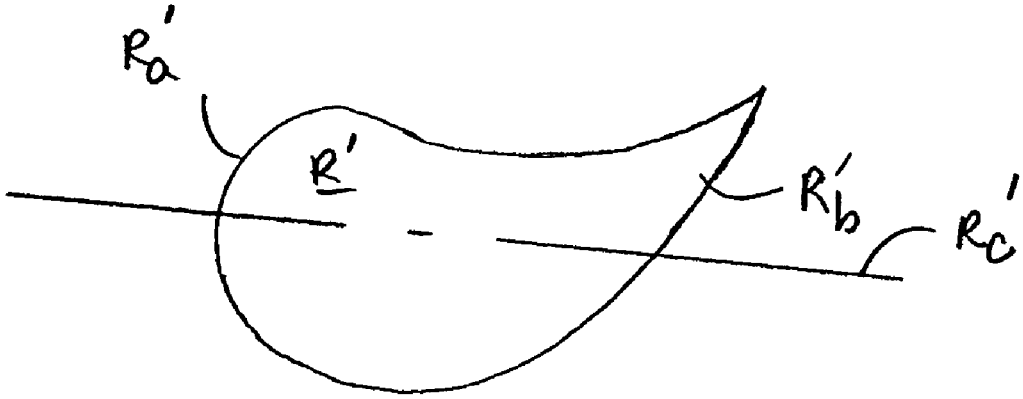
FIG. 13*b* is a top plan view of a wing-shaped external shape of a vibration control rubber member according to another embodiment of the present invention.
Figure 13C:
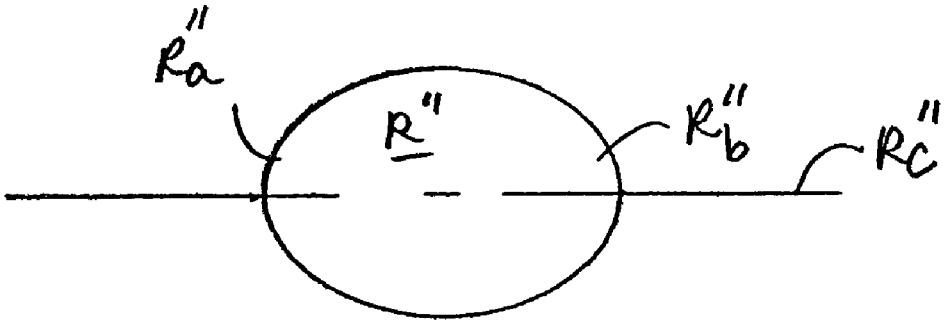
FIG. 13*c* is a top plan view of an ellipse-shaped external shape of a vibration control rubber member according to a further embodiment of the present invention.

With this embodiment, vibration control members inserted between the cooling fins F2, F2, and between cooling fins F3, F3 are realized as vibration control rubbers R so as to collectively form/define a cooling air guide, but this is not limiting and it is also possible to form other elastic bodies. The external shape of the vibration control members is also not limited to a teardrop shape, and can be a wing section shape (FIG. 13*b*), or an elliptical shape (FIG. 13*c*), or any streamlined shape. Also, the number of vibration control rubbers used, and their arrangement, can be appropriately selected. Still further, differently shaped vibration control rubbers can be used together in a single application such that the different shapes and/or the different orientations of the vibration control rubbers between the cooling fins collectively form/define an appropriate cooling air guide.

The air-cooled internal combustion engine of the present invention has been described for a motorcycle, but can be adopted in various vehicles.

Although the present invention has been described herein with respect to an illustrative embodiment, the foregoing description is intended to be illustrative, and not restrictive. Those skilled in the art will realize that many modifications of the embodiment could be made which would be operable. All such modifications which are within the scope of the claims are intended to be within the scope and spirit of the present invention.

We claim:

1. A cooling unit for an air-cooled internal combustion engine, comprising:

a plurality of cooling fins maintaining a specified distance from an outer surface of the engine while mutually facing a flat surface section of the engine, and extending horizontally outwards a specified length, and vibration control members interposed between relatively facing ones of said cooling fins, the vibration control members being disposed in different orientations between said cooling fins, and the vibration control members being arranged between the cooling fins based on said different orientations thereof so as to form a cooling air guide for air to flow between the cooling fins.

2. The cooling unit of claim 1, wherein:

the cooling fins are positioned at a side outer surface of the internal combustion engine extending parallel to a traveling direction of the engine, and the vibration control members are arranged between adjacent ones of said cooling fins such that longitudinal axes of the vibration control members are arranged at different acute angles with respect to a traveling direction of the engine.

3. The cooling unit of claim 1, wherein an external shape of the vibration control members is streamlined.

4. The cooling unit of claim 1, wherein an external shape of the vibration control members when viewed in plan is at least one of teardrop shape, a wing section shape and an elliptical shape.

5. The cooling unit of claim 1, wherein the cooling fins are positioned at a side outer surface of the internal combustion engine extending parallel to a traveling direction of the engine, and the cooling air guide directs air flow to rear surfaces of the engine.

6. The cooling unit of claim 1, wherein the vibration control members have longitudinal axes arranged at different acute angles with respect to the traveling direction of the engine, said acute angles becoming progressively larger depending on the location thereof with respect to an advancing direction of a vehicle on which the engine is to be mounted.

7. The cooling unit of claim 1, wherein the engine includes multiple cylinder bores arranged in parallel such that a cylinder block of the engine is substantially rectangular and is longer in a lateral direction wit respect to a vehicle on which the engine is to be mounted, the coating fins are positioned at outer side surfaces of the internal combustion engine extending parallel to a traveling direction of the engine, and the cooling air guide directs air flow to rear surfaces of the engine.

8. The cooling unit of claim 1, wherein each of the vibration control members is disposed with a predetermined directivity and at a predetermined distance apart from the other vibration control members.

9. The cooling unit of claim 1, wherein a plurality of said vibration control members are disposed between a pair of said cooling fins.

10. The cooling unit of claim 1, wherein said cooling air guide causes air to flow between a pair of said cooling fins substantially parallel to a plane of said cooling fins.

11. A cooling unit for an air-cooled internal combustion engine, comprising:

a plurality of cooling fins maintaining a specified distance from an outer surface of the engine while mutually facing a flat surface section of the engine, and extending horizontally outwards a specified length, and vibration control members interposed between relatively facing ones of said cooling fins, the vibration control members being disposed in different orientations between said cooling fins, and the vibration control members being arranged between the cooling fins based on said different orientations thereof so as to form a cooling air guide for air to flow between the cooling fins, wherein said vibration control members between adjacent ones of the cooling fins are disposed such that longitudinal axes thereof extend at different angles with respect to a traveling direction of the engine, and said angles are larger for those of the vibration control members positioned further to the rear of the side surface of the engine than for those of the vibration control members positioned in the middle of the side surface of the internal combustion engine.

12. A cooling unit for an air-cooled internal combustion engine, comprising;

a plurality of cooling fins maintaining a specified distance from an outer surface of the engine while mutually facing a flat surface section of the engine, and extending horizontally outwards a specified length, wherein the cooling fins are positioned at a side outer surface of the internal combustion engine extending parallel to a traveling direction of the engine, and vibration control members interposed between relatively facing ones of said cooling fins, wherein the vibration control members are arranged between adjacent ones of said cooling fins such that longitudinal axes of the vibration control members are arranged at different acute angles with respect to a traveling direction of the engine, the vibration control members being disposed in different orientations between said cooling fins, wherein the acute angles of longitudinal axes of the vibration control members with respect to the traveling direction of the engine are larger for those of the vibration control members positioned further to the rear of the side surface of the engine than for those of the vibration control members positioned in the middle of the side surface of the internal combustion engine, and the vibration control members being arranged between the cooling fins based on said different orientations thereof so as to form a cooling air guide for air to flow between the cooling fins.

13. An air-cooled internal combustion engine comprising:

a cylinder block having a plurality of cylinder bores, a cylinder head connected to an upper portion of said cylinder block, the connected cylinder block and cylinder head forming a generally elongate rectangular body such that the front side surface of the rectangular body corresponds to the forward traveling direction and is long relative to the lateral side surfaces of the rectangular body, and an air cooling structure including plural cooling fins extending from at least one of the lateral side surfaces of the rectangular body and plural elastic members positioned between confronting surfaces of adjacent ones of said cooling fins, each elastic member having a shaped exterior and being positioned and oriented with respect to the cooling fins so as to direct air flow about the lateral side surface and to the rear side surface of the rectangular body such that the rear side surface receives air flow thereupon.

14. The air-cooled internal combustion engine of claim 13 wherein each elastic member is positioned and oriented so as to prevent the occurrence of a separation phenomenon of the air flow from the elastic member.

15. The air-cooled internal combustion engine of claim 13 wherein said elastic members are streamlined in shape.

16. The air-cooled internal combustion engine of claim 13 wherein an external shape of the elastic members when viewed in plan is at least one of teardrop shape, a wing section shape and an elliptical shape.

17. The air-cooled internal combustion engine of claim 13 wherein each elastic member is press fit between the confronting surfaces of adjacent cooling fins.

18. The air-cooled internal combustion engine of claim 13 wherein the plural elastic members are positioned at locations spaced a small distance from peripheral edges of associated ones of the cooling fins along a curved line that substantially mirrors the edge shape of the associated cooling fins.

19. The air-cooled internal combustion engine of claim 13, wherein those of the elastic members provided between an adjacent pair of the cooling fins have longitudinal axes arranged at different angles with respect to the front side surface of the engine.

20. The air-cooled internal combustion engine of claim 13, wherein angles of longitudinal axes of the elastic members with respect to an advancing direction of the engine when mounted on a vehicle are larger for those of the elastic member positioned further to the rear of the lateral side surface of the engine than for those of elastic members positioned in the middle of the lateral side surface of the engine.

21. A cooling unit for an air-cooled internal combustion engine, comprising:

a plurality of cooling fins maintaining a specified distance from an outer surface of the engine while mutually facing a flat surface section of the engine, and extending horizontally outwards a specified length, and vibration control members interposed between relatively facing ones of said cooling fins, the vibration control members being arranged between the cooling fins so as to form a cooling air guide for air to flow between the cooling fins which directs the air flow about a lateral side surface to a rear surface of the engine, based on at least one of orientations of the vibration control members and shapes of the vibration control members.

22. The cooling unit of claim 21, wherein:

the cooling fins are positioned at a side outer surface of the internal combustion engine extending parallel to a traveling direction of the engine, and the vibration control members are arranged between adjacent ones of said cooling fins such that longitudinal axes of the vibration control members are arranged at different acute angles with respect to a traveling direction of the engine.

* * * * *